US007066440B2

(12) United States Patent
Titcomb et al.

(10) Patent No.: US 7,066,440 B2
(45) Date of Patent: Jun. 27, 2006

(54) WALER BRACKET WITH ATTACHED WEDGE FOR CONCRETE FORMS

(76) Inventors: Ted Titcomb, 18 Old County Rd., East Sandwich, MA (US) 02537; Paul Sherman Titcomb, 51 Pleasant St., Bourne, MA (US) 02561

( * ) Notice: Subject to any disclaimer, the term of this patent is extended or adjusted under 35 U.S.C. 154(b) by 0 days.

(21) Appl. No.: 10/985,512

(22) Filed: Nov. 10, 2004

(65) Prior Publication Data

US 2006/0097128 A1 May 11, 2006

(51) Int. Cl.
*E04G 17/00* (2006.01)

(52) U.S. Cl. ..... 249/219.2; 249/45; 249/219.1

(58) Field of Classification Search ..... 249/45, 249/196, 219.1, 219.2
See application file for complete search history.

(56) References Cited

U.S. PATENT DOCUMENTS

| | | | | |
|---|---|---|---|---|
| 2,879,576 | A * | 3/1959 | Imonetti | 249/219.2 |
| 3,712,576 | A * | 1/1973 | Dagiel | 249/219.2 |
| 4,210,306 | A * | 7/1980 | Schimmel | 249/196 |
| 4,508,310 | A * | 4/1985 | Schultz | 249/219.2 |
| 5,562,845 | A * | 10/1996 | Miller et al. | 249/45 |
| 6,322,047 | B1 * | 11/2001 | Holmboe, Jr. | 249/219.2 |

FOREIGN PATENT DOCUMENTS

| | | | | |
|---|---|---|---|---|
| FR | 2557648 | * | 7/1985 | 249/219.1 |

* cited by examiner

*Primary Examiner*—Jong-Suk (James) Lee

(57) ABSTRACT

A waler bracket for use with a concrete forming systems which incorporates a captive wedge for tightening the wale against the form panels to bring them into planar alignment. The wedge is held in it's open position by means of a notch in it's edge.

4 Claims, 4 Drawing Sheets

WALER BRACKET WITH ATTACHED WEDGE FOR CONCRETE FORMS

BACKGROUND OF THE INVENTION

There is in widespread use a plywood forming system, here referred to as the "1⅛" plywood forming system". This system consists of 1⅛" thick plywood panels, typically 24" wide by 8 feet high, reinforced with ¼"×2" steel straps secured horizontally at regular intervals, to the ends of which are attached swinging steel latches which interconnect the individual panels into a continuous wall and also secure the flattened wire snap ties which hold the opposing panel wall assemblies in position against the hydrostatic force of the liquid concrete.

The panel latches are pivotally attached to the ends of the ¼"×2" steel straps, herein called form panel bars, with hex head shoulder bolts, herein called panel bolts, and engage a similar bolt in the adjoining panel. Additionally, an extra bolt is usually applied to said form panel bars, which is available for attaching various brackets and stiffeners.

It is frequently desired to attach horizontal stiffening members, or walers, to the outside faces of the plywood form panels. These walers commonly consist of a 2"×4" or 2"×6" board and are generally held in position against the form by multiple brackets in the general form of a shelf bracket, with a vertical member to keep the waler approximately held against the form panels. Some prior art brackets have incorporated means of pressing the waler against the form panels, using wedges, cams, or other devices. For instance, U.S. Pat. No. 4,508,310 describes a waler, which incorporates an attached wedge, held in a receiving position for the waler by a keeper attached below the body of the waler.

SUMMARY OF THE INVENTION

The purpose of the present invention is to provide a waler bracket or clamp with an attached wedge for firmly holding the waler against the form panels, which is substantially easier to manufacture than prior art waler brackets. It is also the purpose of the present invention to provide a waler bracket in which the action of seating the waler and applying the wedging action is substantially easier and quicker than prior art versions. Previous designs have required that the device be assembled from several components by arc welding or other labor-intensive means. The likelihood of variation in the assembly of the individual parts tends to produce a product that is often functionally defective. The present invention lends itself to production techniques which have less variation and can be produced more efficiently. In one embodiment of the invention, the release of a wedge, and it's action can be initiated automatically by creating interference between the lower portion of the loose wedge and the wale member. This interference causes the wedge to rotate out of its raised position and drop down between a vertical lip of the bracket and the wale member, forcing it against the forming panels and bringing them into planar alignment.

In another embodiment of the invention, the vertical slotted portion of the bracket is extended a certain distance below the bottom of the form panel bar that the mounting stud bolt is attached, and is slightly offset towards the surface of the plywood form panel. When force is applied downward and outward on the bracket in normal use, the end of said vertical portion comes into contact with the surface of the plywood form panel, thus moving the fulcrum point of the arm further from the attachment stud, greatly increasing the strength and rigidity of the bracket and also preventing accidental rotation of the bracket longitudinally around the stud.

DETAILED DESCRIPTION OF THE INVENTION

Figure 1:
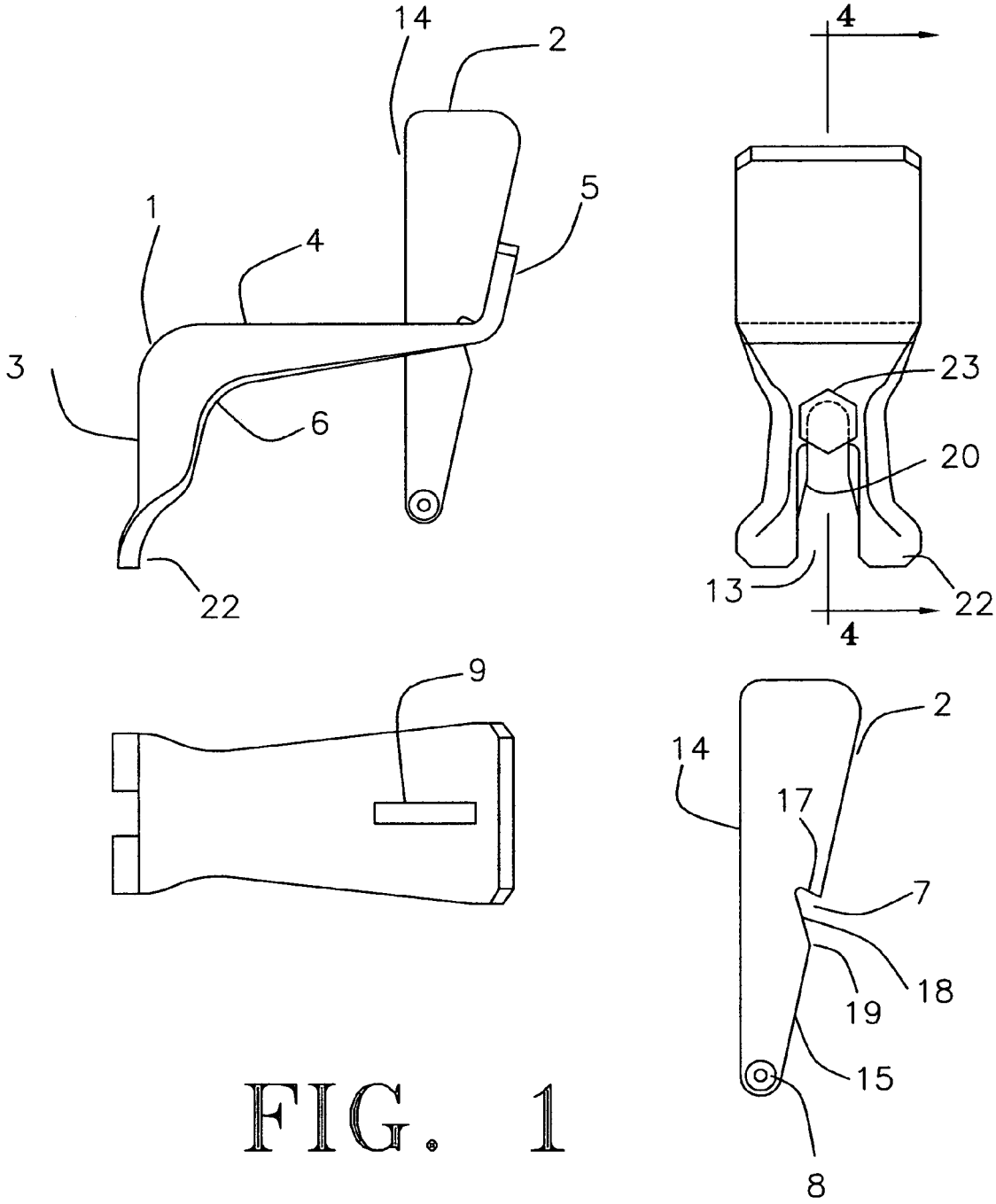
FIG. 1 shows the plan, side, and front views of the waler bracket and a side view of the wedge with notch.

FIG. 1 shows a bracket or clamp 14 consisting of a body 1 and a loosely attached wedge 2. Waler body 1 consists of a substantially vertical member 3, a substantially horizontal member 4, and a substantially vertical lip member 5 on the opposite end of member 4 from vertical member 3. Additionally, there may be one or more stiffening flanges formed into waler body 1 or welded to it. Slot 13 on vertical member 3 engages the headed stud 23 used as a fastening device on the form panels. Wedge 2 passes though slot 9 in member 4 of the waler body 1 and is restrained within the slot by protuberance 8. Wedge 2 includes a substantially vertical surface 14 and an opposed surface 15, inclined to surface 14 by a suitable angle. Additionally, surface 15 is interrupted by notch 7 including surface 17 and surface 18, and corner 19 formed by the intersection of surface 18 and surface 15. Said notch can be more or less hook shaped depending on the required degree of engagement with the vertical lip 5.

Figure 2:
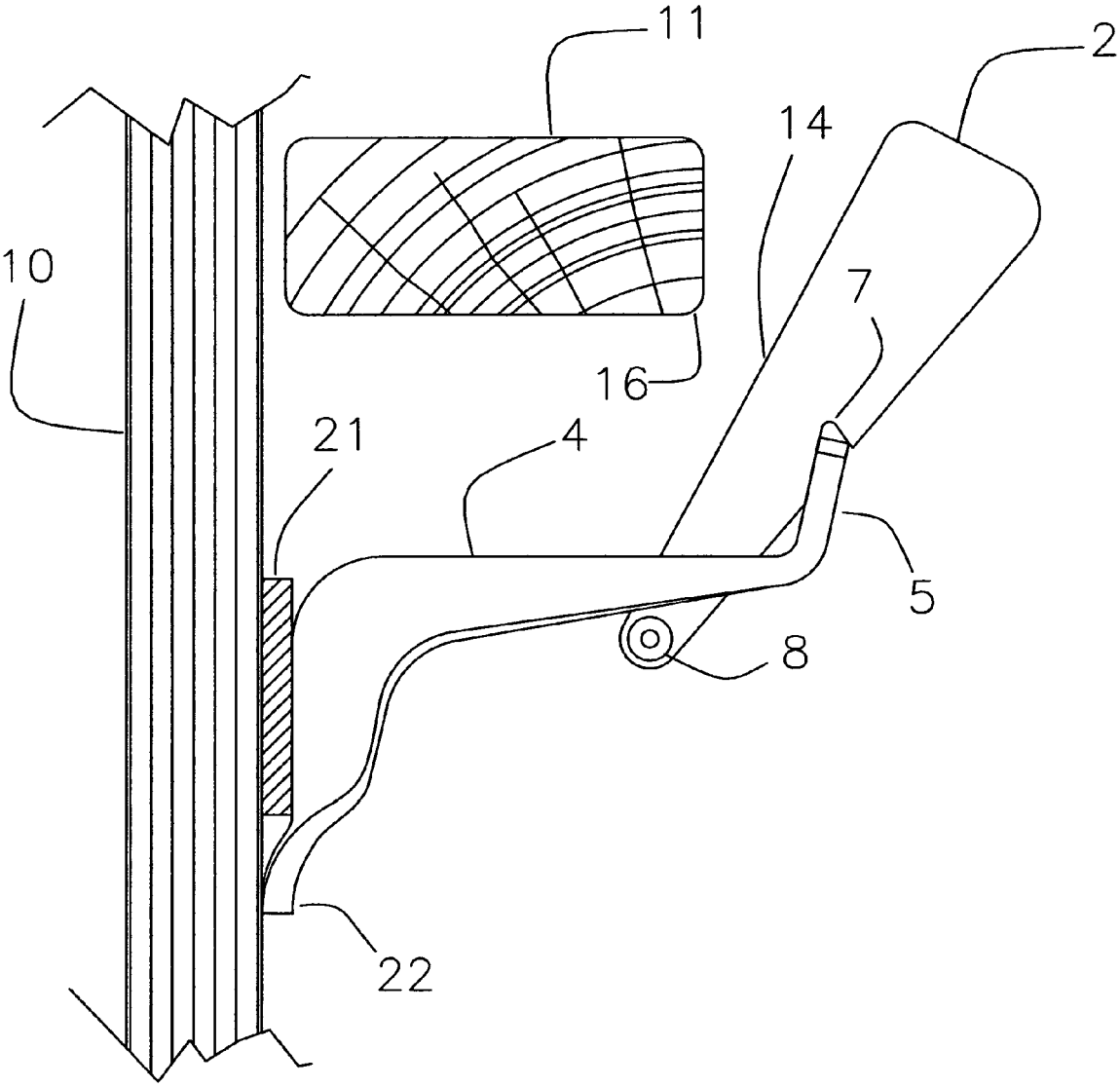
FIG. 2 shows a side view of the waler bracket with captive wedge in position to receive the waler.
Figure 3:
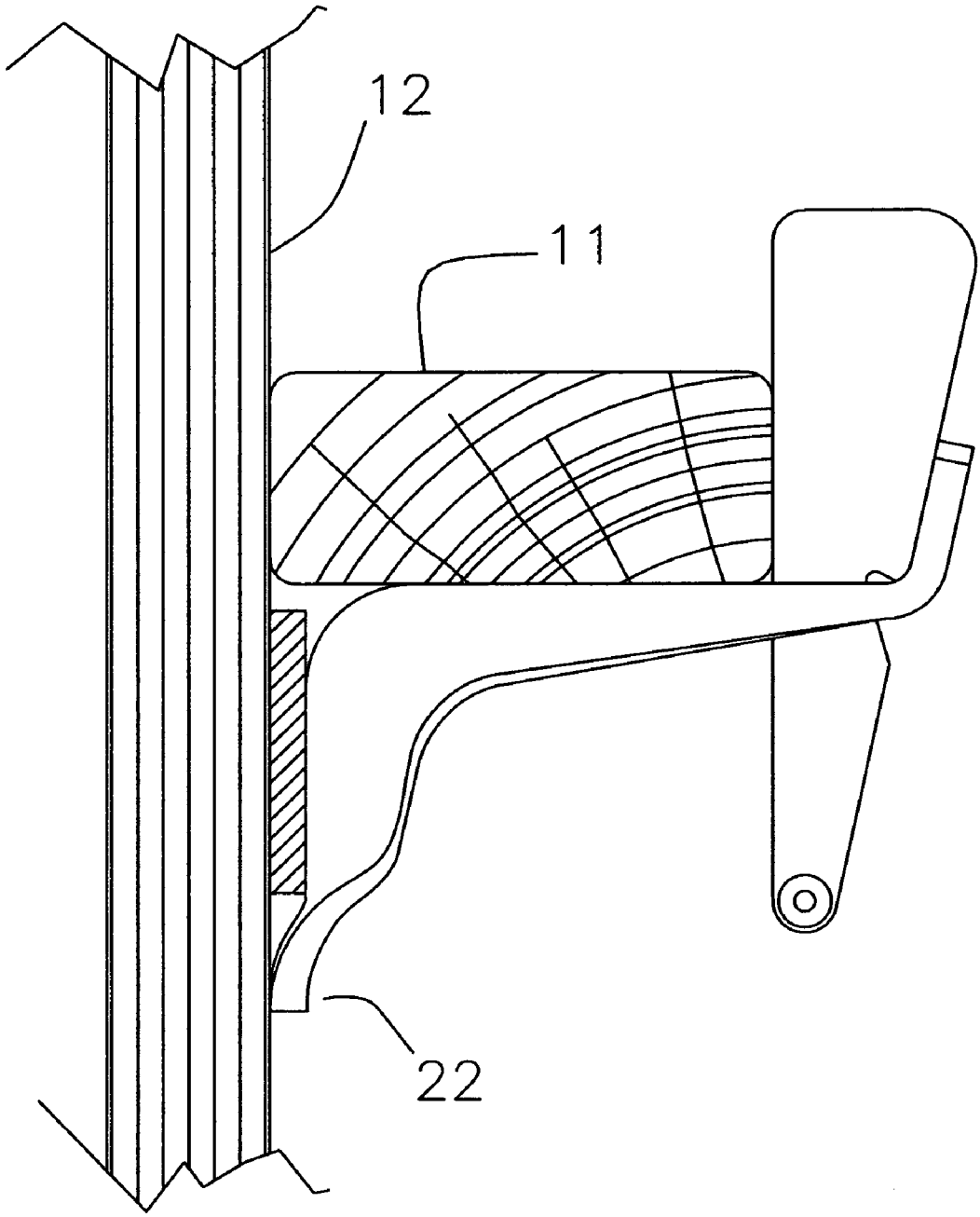
FIG. 3 shows a side view of the waler bracket with captive wedge in its useful position with the waler clamped tightly in contact with the form panel.

FIG. 2 shows the waler bracket disposed to receive the waler 11. In preparation to receive the waler, wedge 2 is raised until notch 7 engages the top edge of lip member 5 on water body 1. Notch 7 is located below the center of gravity of wedge 2, causing the wedge to pivot around top edge of said lip member 5 in such a way as to cause the top of wedge 2 to move away from form panel 10. This pivoting motion is restrained by protuberance 8 on wedge 2 contacting the lower surface of member 4 of waler body 1. As waler 11 is lowered into position onto the waler bracket, corner 16 of waler 11 comes into contact with surface 14 of wedge 2, causing wedge 2 to now pivot about corner 19 so that the top of the wedge now moves toward form panel 10. This pivoting motion about corner 19 causes notch 7 to lose its engagement with the top of lip member 5 of waler body 1, allowing the wedge to drop freely. Alternately, when it is not desirable to have the wedge disengage the lip member 5 immediately upon contact with said waler, notch 7 can be formed with a more acute angle between hook surfaces 17 and 18. In this embodiment, as waler 11 is lowered into position onto the waler and contacts surface 14 of the wedge, said wedge retains engagement with lip 5 until the wedge is lifted up and out of engagement with said lip. The force of waler member 11 upon wedge surface 14 now brings wedge surface 2 into parallel alignment with waler outer vertical lip surface 5, allowing said wedge to drop into slot 9. Finally, wedge 2 may be seated tightly between waler 11 and lip member 5 as shown in FIG. 3, with hammer blows.

Figure 4:
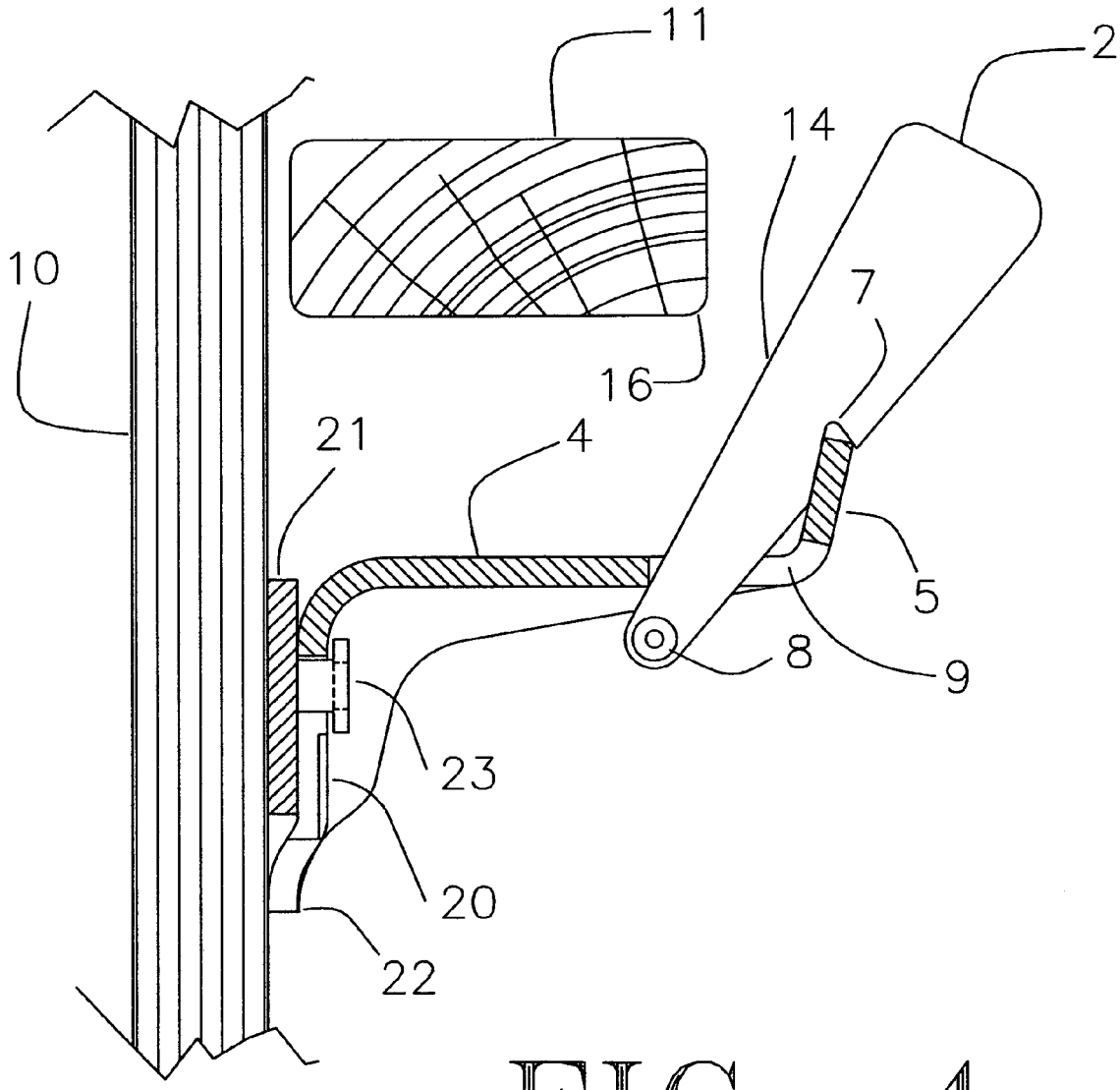
FIG. 4 shows a section view of the waler bracket and captive wedge illustrating the orientation of the wedge in the slot in the waler bracket body, as well as the extended vertical section which attaches to the form panel bar.

FIG. 4 shows a section view of said waler bracket disposed to received the waler as in FIG. 2, with extended vertical portion 22 which engages form panel bar 21 rotationally about the longitudinal axis of stud 23, thus preventing further rotation of said bracket and subsequent, unintentional disengagement from said stud.

A notch 13 is depressed around a portion of its periphery 20, extending downwardly and outwardly to provide clearance for said stud while applying said bracket to said form panel bar.

The invention claimed is:

1. In a waler bracket assembly for securing horizontal wale components to form panels comprising;

In combination, a singularly formed Z shaped bracket having a form panel receiving vertical portion adapted to engage the head of a panel bolt, a substantially horizontal ledge section adapted to receive and guide a clamping wedge, and an outer opposing, substantially vertical lip section angularly oriented to said ledge section opposing the stress developed by said wedge acting between said vertical lip section and the supported wale member, wherein the improvement comprises; a wedge that is notched in a hook shape on the upper transition to it's edge surface to provide a locking engagement to the lip of the vertical portion of the bracket, thus preventing the wedge from dropping and engaging said wale member until said wedge is lifted upwardly out of its engagement with said lip and guided in a perpendicularly downward direction to the ledge section.

2. In a waler bracket assembly for securing wale components to form panels comprising;

In combination, a singularly formed Z shaped bracket having a form panel receiving vertical portion adapted to engage the head of a panel bolt, a substantially horizontal ledge section adapted to receive and guide a clamping wedge, and an outer, opposing, substantially vertical lip section angularly oriented to said ledge section opposing the stress developed by said wedge acting between it said vertical lip section and the supported wale member, wherein the improvement comprises; a vertical, panel-engaging portion which extends downwardly below an attached form panel bar and then offsets inwardly toward the surface of said form panel to contact the plywood surface of said form panel and interfere with the bottom edge of said form panel bar to prevent rotation of the waler bracket around a headed stud, and extend the fulcrum point of said bracket further from said stud.

3. A waler bracket assembly as in claim 2, wherein the vertical portion of the bracket which engages the stud on the form panel bar is suitably notched to detachably receive said stud, and said notch is depressed around a portion of its periphery, extending downwardly and outwardly to provide clearance for said stud while applying said bracket to said form panel bar.

4. In a waler bracket assembly for securing horizontal wale components to form panels comprising;

In combination, a singularly formed Z shaped bracket having a form panel receiving vertical portion adapted to engage the head of a panel bolt, a substantially horizontal ledge section adapted to receive and guide a clamping wedge, and an outer opposing, substantially vertical lip section angularly oriented to said ledge section opposing the stress developed by said wedge acting between said vertical lip section and the supported wale member, wherein the improvement comprises; a wedge that is notched in a hook shape on the upper transition to it's edge surface to provide a locking engagement to the lip of the vertical portion of the bracket at an angle which allows said wedge to rotate out of engagement with said lip as the wale member is brought down upon said ledge portion of the bracket.

* * * * *